US006494315B2

(12) United States Patent
Frisk

(10) Patent No.: US 6,494,315 B2
(45) Date of Patent: Dec. 17, 2002

(54) PAINT BRUSH STORAGE LID

(75) Inventor: Steven Jay Frisk, 2937 W. Logan Blvd., Chicago, IL (US) 60647

(73) Assignee: Steven Jay Frisk, Vernon Hills, IL (US)

( * ) Notice: Subject to any disclaimer, the term of this patent is extended or adjusted under 35 U.S.C. 154(b) by 0 days.

(21) Appl. No.: 09/851,980

(22) Filed: May 10, 2001

(65) Prior Publication Data

US 2002/0000388 A1 Jan. 3, 2002

Related U.S. Application Data

(60) Provisional application No. 60/216,038, filed on Jul. 3, 2000.

(51) Int. Cl.[7] ..... B65D 39/14; B65D 51/00; A45D 44/18

(52) U.S. Cl. ..... 206/15.3; 220/377

(58) Field of Search ..... 206/15.2, 15.3, 206/209, 361; 220/736, 377

(56) References Cited

U.S. PATENT DOCUMENTS 824,296 A * 6/1906 Harris ..... 206/15.3
1,779,018 A * 10/1930 Smallwood et al. ..... 206/15.3
1,983,619 A * 12/1934 Lent ..... 206/15.3
2,262,753 A * 11/1941 Brennan ..... 206/209
2,782,909 A * 2/1957 McNamara ..... 206/209
3,955,670 A * 5/1976 Buslik ..... 206/15.3
5,992,617 A * 11/1999 Couch et al. ..... 206/15.3
6,213,329 B1 * 4/2001 Dobson ..... 206/15.3

* cited by examiner

*Primary Examiner*—Bryon P. Gehman

(57) ABSTRACT

A resilient one-piece paint brush storage lid for both storing a paint brush so that it does not need to be rinsed and cleaned, and for keeping the brush from drying while at the same time covering a container of liquid such as paint so that the paint does not evaporate. The one-piece lid has a flat portion covering the container, a depending outer rim portion, and a raised tapered neck portion projecting above the flat portion, with an aperture in the raised neck portion, for slidably receiving a paint brush handle therethrough. The brush is adjustably positionable so that the brush fibers are covered by the liquid up to the ferrule portion of the brush. The storage lid is preferably light transmissive to view the position of the paint brush in relation to the level of the liquid in the container. The raised neck portion extending above the flat portion of the storage lid maintains a sufficiently strong grip on the handle of the brush so as to suspend the weight of the brush. A user can manually move the handle up or down within the lid, and the handle will remain where it has been left. The lid is sized so that it can cover most typical paint can sizes. Several size lids will fit a wide variety of liquid containers.

19 Claims, 6 Drawing Sheets

PAINT BRUSH STORAGE LID

CROSS-REFERENCE TO RELATED APPLICATIONS

This patent application claims priority of Provisional Patent Application, Ser. No. 60/216,038 filed Jul. 3, 2000.

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

The present invention relates to lids for paint cans, and particularly to lids designed to support a paint brush. More particularly, the invention relates to a flexible paint brush storage lid having an aperture for receiving and supporting a paint brush inside a partially filled paint can.

2. Background of the Invention

Lids for paint cans are known in the prior art. Also, paint brush storage devices are known in the prior art. It is a problem in the art to provide a convenient, inexpensive storage arrangement for both storing a paint brush overnight so that it does not need to be rinsed and cleaned, and to keep the brush from drying while at the same time covering a container of liquid such as paint so that the paint does not evaporate.

U.S. Pat. No. 2,782,909 to McNamara teaches a liquid container with a hole. The hole is used to hold a brush which is lined with rubber to seal the brush in place.

U.S. Pat. No. 1,254,714 to McCombs teaches a combined marking pot and brush. The brush is held in the paint by a funnel-shaped lid, and includes a thick brush to fit in the hole so as to keep air out of contact with the paint.

U.S. Pat. No. 2,703,898 to Kellett teaches a combination brush stripper and liquid seal for containers. It includes a can for liquid having an opening at the top to secure a brush by using rubber lips to hold and seal the brush in place.

U.S. Pat. No. 3,262,556 to Morrison teaches a storage device for paint brushes or the like. It includes a container for liquid, having a hole lined with resilient material such as rubber to hold the brush neck.

U.S. Pat. No. 558,607 to Hollen teaches a lid with an opening in the top to hold a brush in liquid.

U.S. Pat. No. 5,540,363 to Wilson teaches a liquid container with a rubber material used to hold the brush neck while the bristles are still in the liquid.

U.S. Pat. No. 3,291,295 to Coligiuri teaches a liquid container having a sponge rubber member to hold the brush.

U.S. Pat. No. 2,654,504 to Hyams teaches a can lid which keeps a brush suspended in a can.

U.S. Pat. No. 2,262,753 to Brennan teaches a liquid container with an arrangement in the lid for holding a brush inside the container, as well as to seal the can.

U.S. Pat. No. 1,687,179 to Peterson teaches a lid with a hole in it, the hole being surrounded by foam, for holding a brush in place.

U.S. Pat. No. 752,591 to Robinson teaches a lid for a can with a hole in the middle for a brush, so that the brush stays wet.

U.S. Pat. No. 739,970 to Zimmerman teaches a lid for a can with a brush, having a wide cover to keep it in place.

U.S. Pat. No. 563,178 to Humphrey teaches a can with an attachment to hold a brush inside a sealed can.

U.S. Pat. No. 557,118 to Ellis teaches a can lid with a hinged opening, to seal during insertion of the brush into the lid.

U.S. Pat. No. 402,679 to Leggett teaches a can lid that rotates to have a brush to stick through the lid while the rest of the can is sealed.

BRIEF SUMMARY OF THE INVENTION

From the foregoing, it is seen that it is a problem in the art to provide a device meeting the above requirements. According to the present invention, a device is provided which meets the aforementioned requirements and needs in the prior art. Specifically, the device according to the present invention provides a convenient, inexpensive storage arrangement for both storing a paint brush so that it does not need to be rinsed and cleaned, and which keeps the brush from drying while at the same time covering a container of liquid such as paint so that the paint does not evaporate between uses.

More particularly, the device according to the present invention is formed as a one-piece lid having a hollow conical projection above the lid which is oblong in a direction parallel to the plane of the lid. The one-piece lid has an aperture in the top portion thereof, for receiving a paint brush handle therethrough. The brush is adjustably positionable so that it is preferably supported so that the brush fibers are covered by the liquid in the paint can. Preferably, the brush is immersed in the liquid up to the ferrule portion of the brush.

The brush is adjustably positionable in the lid. Due to the resiliency of the rubber or rubber-like material used, the uppermost portion of the conical projection above the lid maintains a sufficiently strong grip on the handle of the brush so as to suspend the weight of the brush. A user can, by manual force, move the handle up or down within the lid, and the handle will remain where it has been left.

The lid is sized so that it can cover most typical paint can sizes. However, it is not necessary that the lid fit in a snug manner, rather the lid may be simply rested upon the upper rim of a can of liquid such as a paint can. Instead, the lid is intentionally designed to be oversized, so that it will fit a wide variety of paint cans.

Due to the material used for the lid, a sufficiently good seal is maintained to aid in preventing evaporation of the liquid, and to prevent drying of the brush. In this manner, the paint brush can be stored in the paint can during repeated use day after day, even for several weeks. The paint brush storage lid disclosed herein is easy and simple to use.

In a preferred embodiment, the lid is formed as a one-piece member, by molded construction, using Synair Por-A-Mold 2060 flexible rubberlike polyurethane, shore A58 hardness. The color is preferably clear or amber, although coloring agents can be used. Where the color is clear, or light transmissive, the user may visually position the brush properly so that the bristles are covered by the liquid.

Other objects and advantages of the present invention will be more readily apparent from the following detailed description when read in conjunction with the accompanying drawings.

DETAILED DESCRIPTION OF THE INVENTION

Figure 1:
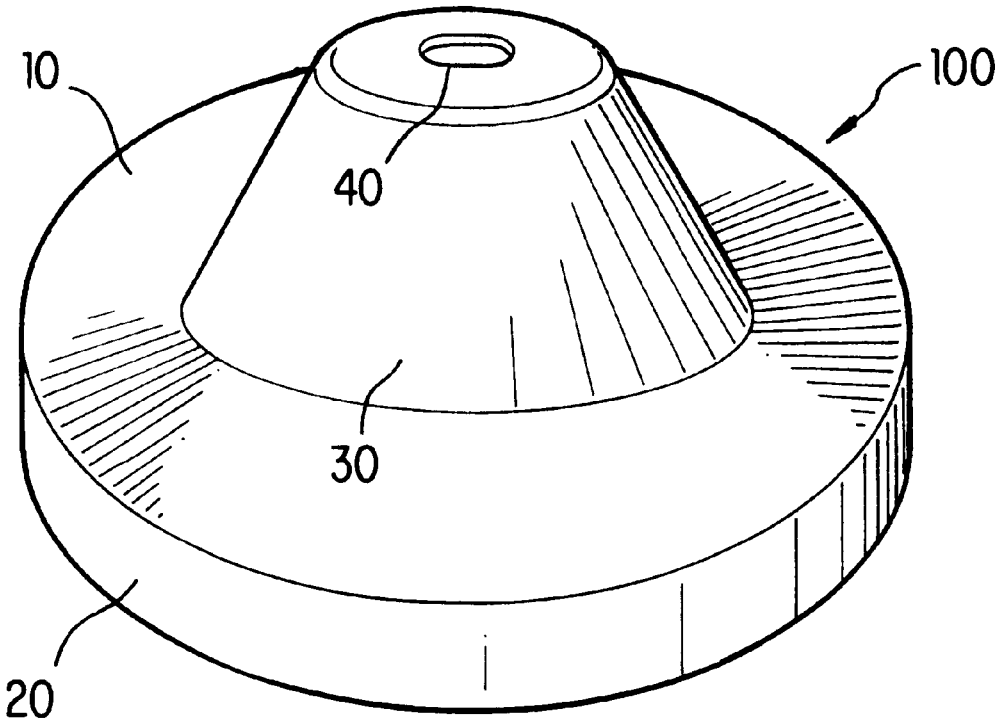
FIG. 1 is a perspective view of a paint brush storage lid according to the present invention.

FIG. 1 is a perspective view of a paint brush storage lid 100 according to the present invention. The paint brush storage lid 100 is formed as a one-piece lid having a flat portion 10 sized to cover to top opening portion of a paint can or other suitable container 90 (hereinafter paint can). The flat portion 10 is bounded at its outer periphery by a rim portion 20 which extends below the flat portion 10. A hollow tapered neck portion 30 projects above the flat portion 10, and is oblong in a direction perpendicular to the plane of the flat portion 10. The hollow tapered neck portion 30 has a handle aperture 40 in the uppermost portion thereof, for slidably receiving and supporting a paint brush handle 80 securely therethrough. Preferably, the handle aperture 40 has a reduced thickness 60 in proximity to the handle aperture 40 for increased flexibility at the handle aperture 40, as shown in FIG. . This enables the user to more easily insert the brush handle 80 through the handle aperture 40. The handle aperture 40 is preferably an aperture having elongated parallel sides 42, with rounded ends 44.

In use, the paint brush handle 80 is adjustably positioned in the handle aperture 40 so that the paint brush fibers 82 extend downward into the paint can 90, where the paint brush fibers 82 are preferably substantially covered by the liquid 15 in the paint can 90. Preferably, the paint brush bristles or fibers 82 are immersed in the liquid 15 up to the ferrule portion 84 of the paint brush 78.

The paint brush 78 handle 80 is adjustably positioned in the handle aperture 40 of the paint brush storage lid 100. Due to the resiliency of the rubber or rubber-like material used, the elongated aperture 40 in the hollow tapered neck portion 30 maintains a sufficiently strong grip on the handle 80 of the brush 78 so as to suspend the weight of the brush 78. A user can, by manual force, move the paint brush handle 80 up or down within the handle aperture 40 located in the top portion 50 of the hollow tapered neck portion 30, and the handle 80 will remain where it has been left in the paint brush storage lid 100.

Thus, the paint brush storage lid 100 provides a convenient, inexpensive storage arrangement for both storing a paint brush 78 so that it does not need to be rinsed and cleaned between use, and which keeps the brush 78 from drying out while at the same time covering a container of liquid, such as a paint can 90, so that the liquid 15 in the paint can 90 does not evaporate.

In a preferred embodiment, the paint brush storage lid 100 is formed as a one-piece resilient member, by molded construction, using a rubber or other resilient material, such as Synair Por-A-Mold 2060 flexible rubber-like polyurethane. The thickness of the paint brush storage lid 100 wall 17 is preferably from 1/16 of an inch to one-quarter of an inch to suit the type of resilient material used.

The color of the resilient material 20 is preferably clear or amber, although coloring agents can be used. The color of the resilient material 20 is preferably light transmissive, so that the user may visually position the brush within the paint can 90 so that the paint brush fibers or bristles 82 are covered by the liquid 15.

Figure 2:
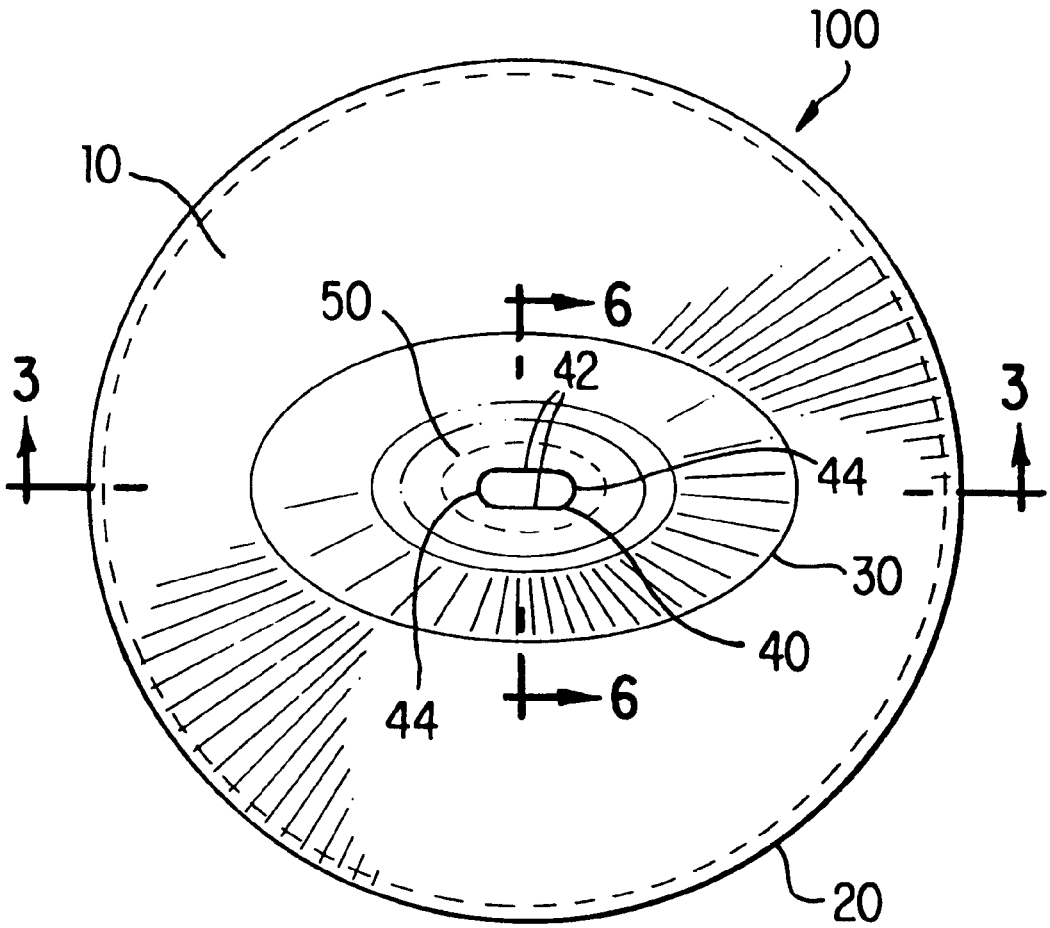
FIG. 2 is a top elevational view of the device of FIG. 1.

FIG. 2 is a top elevational view of the device of FIG. 1. The oblong shape of the hollow tapered neck portion 30 is provided to accommodate the generally elongated width of most paint brushes 78. The handle aperture 40 is shown as being centered in the middle of the top portion 50; however, it need not be centered therein. The hollow tapered neck portion 30 of the paint brush storage lid 100 is preferably symmetrical as shown in FIG. 2. Variations in size, shape, and positioning of the hollow tapered neck portion 30 relative to the center of the flat portion 10 are contemplated as being within the scope of the present invention.

Figure 3:
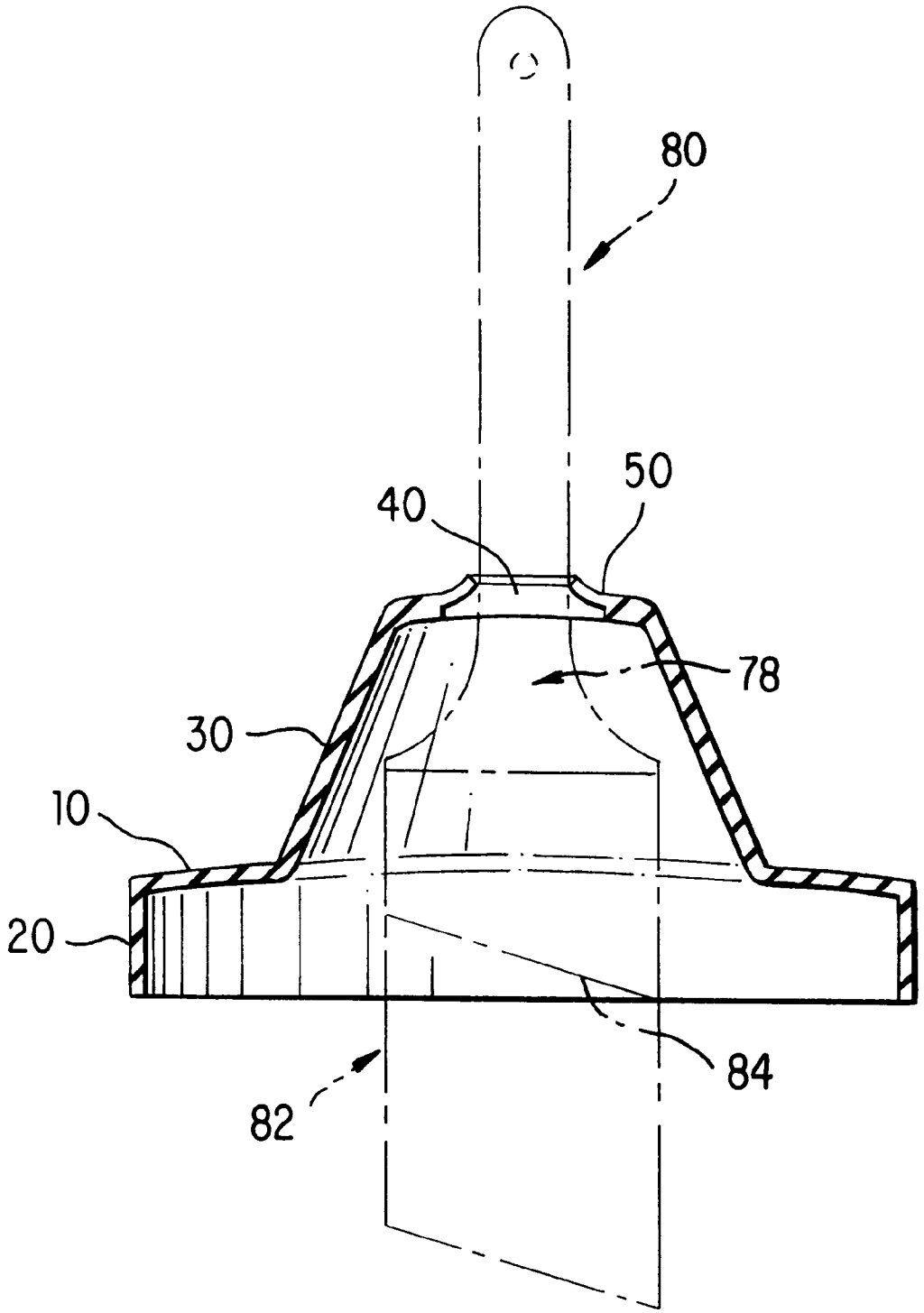
FIG. 3 is a side sectional view of the paint brush storage lid of FIG. 2, taken along line 3—3 of FIG. 2.

FIG. 3 is a side sectional view of the paint brush storage lid 100 of FIG. 2, taken along lines 3—3 of FIG. 2. In this view, a paint brush 78 is shown in phantom outline, so that the use of the paint brush storage lid 100 is apparent. The paint brush handle 80 is held within the handle aperture 40 of the paint brush storage lid 100, and is slidably received within the handle aperture 40 so that the paint brush bristles or fibers 82 are positioned in relation to the height of the liquid 15 within the paint can 90. In this view, it is apparent that the entire paint brush storage lid 100 is formed so that it is relatively thin, and therefore it is readily resilient, deformable, lightweight, and inexpensive to mold.

Figure 4:
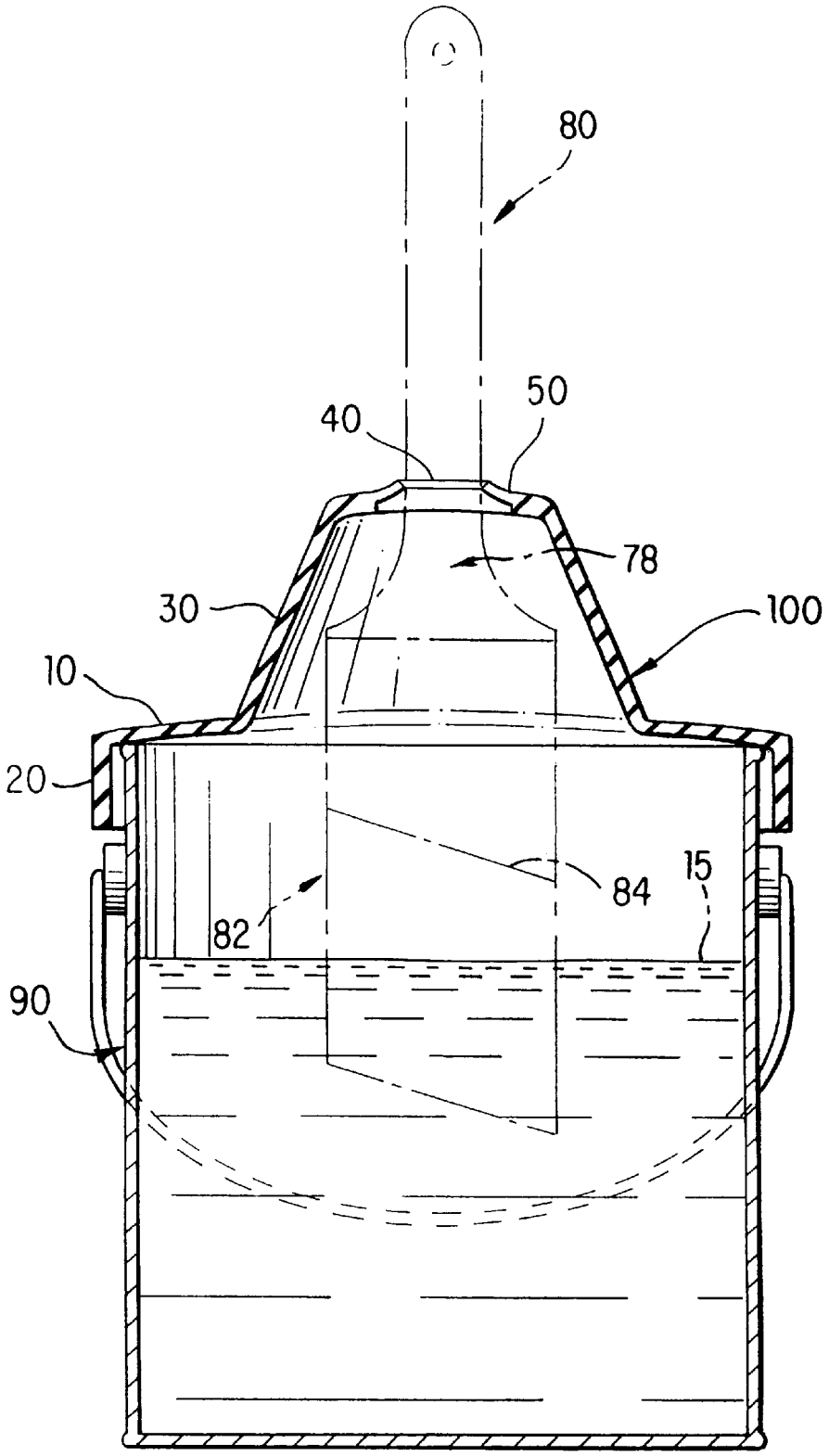
FIG. 4 is a side sectional view of the paint brush storage lid similar to that of FIG. 3, covering a can of liquid and holding a brush (shown in phantom outline) therein.

FIG. 4 is a side sectional view of the paint brush storage lid 100 similar to that of FIG. 3, together with a paint can 90 containing a liquid 15, and holding a paint brush 78 (shown in phantom outline) therein. In this view, the liquid level 16 is relatively low, and covers only a portion of the bristles of the brush 80; accordingly, the brush handle 80 can be pushed further into the aperture 40 of the paint brush storage lid 100, so that a greater portion of the paint brush bristles or fibers 82 are covered by the liquid 15. The liquid 15 may, for example, be paint, varnish, paint thinner, or other liquid material subject to evaporation.

Figure 5:
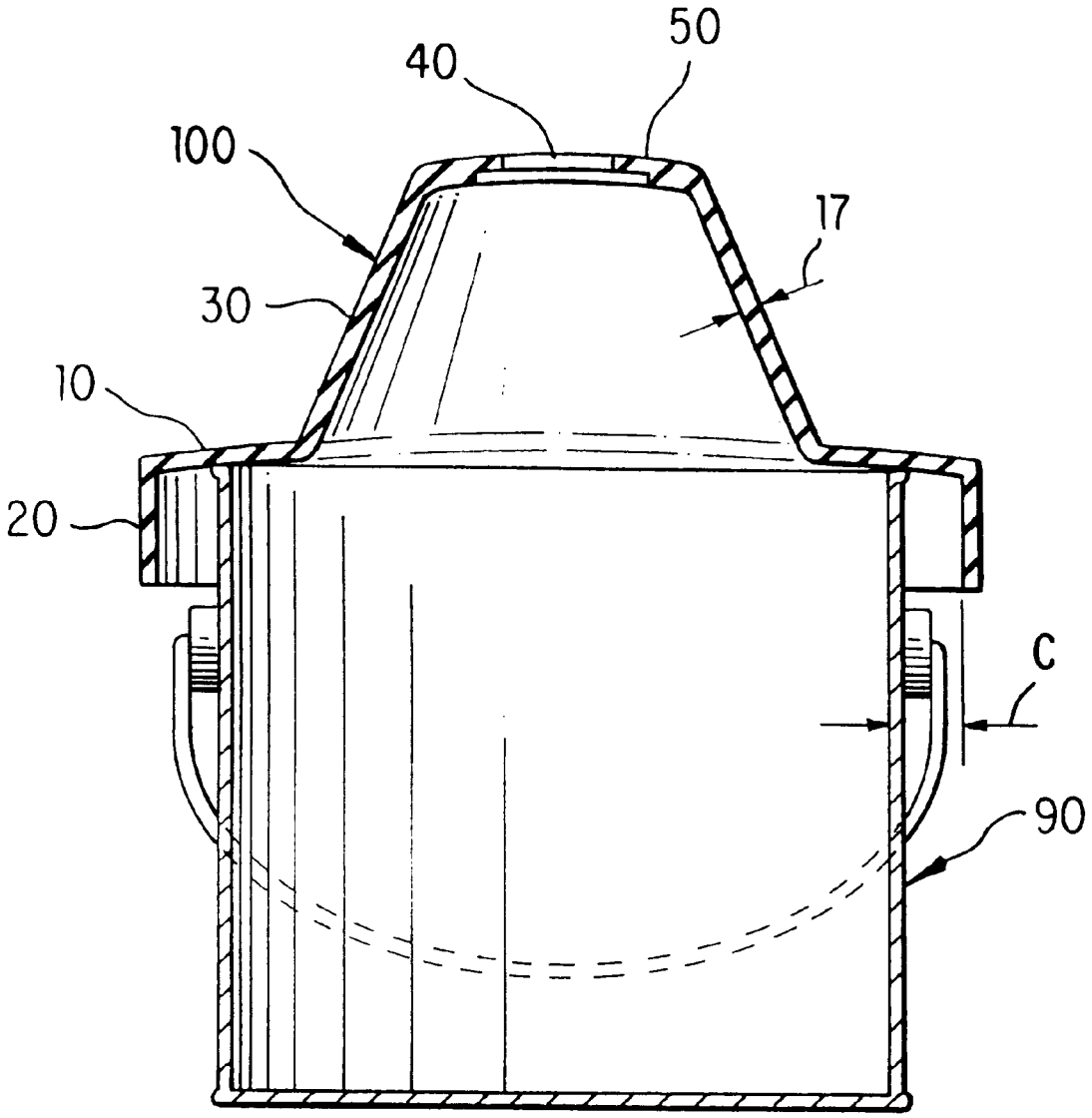
FIG. 5 is a side sectional view of the paint brush storage lid similar to that of FIG. 3, covering a can of liquid which is smaller in diameter than the paint brush storage lid.

FIG. 5 is a side sectional view of the paint brush storage lid 100 similar to that of FIG. 3, covering a can of liquid 110 which is smaller in diameter than the paint brush storage lid 100. The paint brush storage lid 100 is sized so that it can cover most typical paint can 90 sizes. However, it is not necessary that the paint brush storage lid 100 fit in a snug manner about the top opening in a paint can 90, rather the flat portion 10 of the paint brush storage lid 100 may simply rest upon the upper rim 92 of a can 90 of liquid 15 such as a paint can 90. Instead, the paint brush storage lid 100 is intentionally designed to be oversized, so that it will fit a wide variety of paint cans 90.

Figure 6:
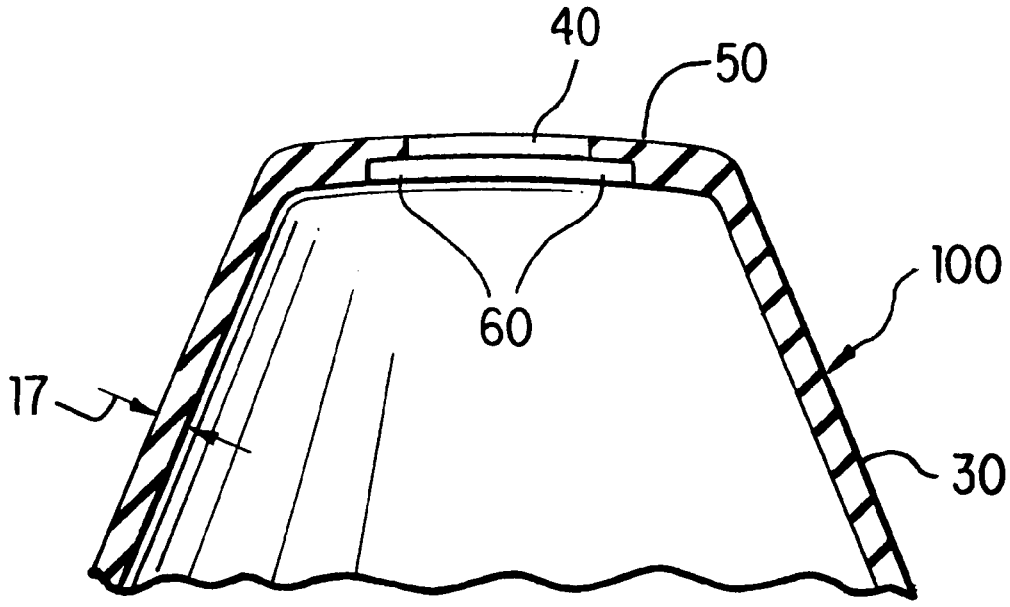
FIG. 6 is a cross-sectional view of a portion of the storage lid, showing a reduced material thickness in proximity to the elongated aperture in the tapered neck portion.

FIG. 6 is a cross-sectional view of a portion of the storage lid, showing a reduced material thickness 60 in proximity to the elongated handle aperture 40 in the tapered neck portion 30 of the storage lid 100.

Several sizes of paint brush storage lids 100 may be provided to suit the needs of various users, such as for artists using small containers, for painters using up to five gallon containers; and for industrial users using up to 55 gallon containers.

Due to the use of resilient material 20 for the forming of the paint brush storage lid 100, a sufficiently good seal is provided between the flat portion 10 of the paint brush storage lid 100 and the upper rim 92 of a paint can 90. This aids in preventing evaporation of the liquid, and stops the drying of the brush bristles 82. In this manner, the paint brush 90 can be stored in the paint can 110 for extended periods of time during repeated use, such as overnight, or even weeks.

When the user is ready to use the brush 78, the paint brush storage lid 100 is raised from the upper rim 92 of the paint can 90, and the paint brush handle 80 is withdrawn from the handle aperture 40 by pulling the paint brush from within the hollow tapered neck portion 30. The user may then use the paint brush 78 in a typical manner, dipping the paint brush bristles 82 into the liquid 15 as needed.

Upon completion of the painting assignment, or when a break from painting is planned, the paint brush handle 80 is inserted into the handle aperture 40 through the raised, hollow tapered neck portion 30. The paint brush storage lid 100 is then replaced upon the upper rim 92 of the paint can, immersing the paint brush bristles 82 into the liquid in the paint can 90. As paint or other liquid 15 is withdrawn from the paint can 90, the paint brush handle 80 is lowered in the handle aperture 40 so that the paint brush bristles 82 remain coated by the liquid 15 in the paint can 90. This ensures that the paint brush bristles 82 will not dry out overnight, on weekends, or during paint breaks, and eliminates the need for cleaning the brush 82 between use, while reducing evaporation of the liquid within the container 90.

The invention being thus described, it will be evident that the same may be varied in many ways. Such variations are not to be regarded as a departure from the spirit and scope of the invention and all such modifications are intended to be included within the scope of the claims.

What is claimed is:

1. A paint brush storage lid, comprising:

a paint brush storage lid with a flat portion sized to cover a top portion of a liquid container, the paint brush storage lid with a depending rim portion which extends below the flat portion to strengthen the outer periphery of the paint brush storage lid; the paint brush storage lid with a hollow tapered neck portion which projects above the flat portion, said hollow tapered neck portion of oblong shape in a direction perpendicular to the plane of the flat portion, said hollow tapered neck portion sized to receive a part of a paint brush handle portion therein, the paint brush storage lid with an elongated aperture located in the uppermost portion of the hollow tapered neck portion; said elongated aperture sized to slidably receive and frictionally releasably secure a part of a paint brush handle portion therethrough, the paint brush storage lid made of a resilient, light transmissive material to provide a position of a plurality of paint brush bristles extending from the paint brush handle portion in relation to a level of liquid in the liquid container;

wherein the paint bush handle portion is adjustably positioned in the elongated aperture of the paint brush storage lid to position the plurality of paint brush bristles into the liquid, for storage.

2. The paint brush storage lid of claim 1, wherein the paint brush storage lid is molded of a resilient polyurethane, having a wall thickness selected from a range of one-sixteenth of an inch to one quarter of an inch.

3. The paint brush storage lid of claim 1, wherein the oblong tapered neck portion is sized to accommodate the elongated width of most paint brushes sized to be received within the container.

4. The paint brush storage lid of claim 1, wherein the liquid stored within the liquid container is selected to be at least one of: paint, varnish, paint thinner, or other liquid material subject to evaporation over time.

5. The paint brush storage lid of claim 1, wherein the elongated aperture has elongated parallel sides and rounded ends sized to receive a paint brush handle portion therethrough, and wherein the elongated aperture has a reduced wall thickness extending about the periphery of the elongated aperture.

6. The paint brush storage lid of claim 1, wherein the paint brush handle portion is positioned through the elongated aperture located beneath the hollow tapered neck portion, to position and immerse the plurality of paint brush bristles substantially within the liquid in the liquid container, to store the paint brush without cleaning between a first use and a second use, while covering the liquid in the container so the liquid does not substantially evaporate.

7. The paint brush storage lid of claim 1, wherein the flat portion of the paint brush storage lid may be placed upon the top portion of a container of a smaller size than the depending rim portion of the paint brush storage lid, thus adapting the paint brush storage lid for use upon liquid containers of various sizes.

8. The paint brush storage lid of claim 7, wherein a small size paint brush storage lid is sized to cover liquid containers suitable for artists using small liquid containers; a medium size paint brush storage lid sized for medium sized liquid containers suitable for painters using up to five gallon liquid containers; and a large size paint brush storage lid suitable large size liquid containers suitable for industrial users using up to 55 gallon liquid containers.

9. A paint brush storage lid supported upon a container for holding liquids, comprising:

a) the paint brush storage lid is formed of a resilient, one piece light transmissive material to provide a visual indication of the position of the paint brush in relation to a liquid level in the container, paint brush storage lid having a flat portion sized to cover the top portion of the container;

b) paint brush storage lid with a depending rim portion which extends below the flat portion to strengthen the outer periphery of the paint brush storage lid;

c) paint brush storage lid further has a hollow tapered neck portion which projects above the flat portion, the hollow tapered neck portion of oblong shape in a direction perpendicular to the plane of the flat portion, the hollow tapered neck portion sized to receive a paint brush handle portion with a plurality of bristles extending from the handle portion;

d) paint brush storage lid with an elongated aperture located in the uppermost portion of the hollow tapered neck portion, the elongated aperture with elongated parallel sides and rounded ends sized to receive a part of the handle portion of the paint brush therethrough, said elongated aperture sized to slidably receive and frictionally releasably secure a part of the handle portion of the paint brush extending therethrough;

wherein a part of the paint bush handle is adjustably positioned in the elongated aperture to position the plurality of paint bristles in the liquid within the container for temporary storage regardless of the liquid level in the container, eliminating the need to clean the paint brush between a first use and a second use.

10. The paint brush storage lid of claim 9, wherein the paint brush storage lid is molded of a resilient polyurethane, have a wall thickness selected from a range of one sixteenth of an inch to one quarter of an inch.

11. The paint brush storage lid of claim 9, wherein the oblong tapered neck portion is sized to accommodate the width of a paint brush handle portion sized to be received within the liquid container.

12. The paint brush storage lid of claim 9, wherein the liquid stored within the liquid container is selected to be at least one of: paint, varnish, paint thinner, or other liquid material subject to evaporation over time.

13. The paint brush storage lid of claim 9, wherein the paint brush handle portion is positioned through the elongated aperture beneath the hollow tapered neck portion, to position and immerse the paint brush bristles substantially within the liquid in the liquid container, to store the paint brush without cleaning between a first use and a second use, while covering the liquid container so the liquid does not substantially evaporate.

14. The paint brush storage lid of claim 9, wherein the flat liquid-container portion of the paint brush storage lid may be placed upon a top portion of the liquid container, the liquid container selected to be of smaller size than the paint brush storage lid, thus adapting the paint brush storage lid for liquid containers of various sizes.

15. The paint brush storage lid of claim 14, wherein the flat portion of the paint brush storage lid may be placed upon the top portion of a liquid container, the liquid container of smaller size than the paint brush storage lid, thus adapting a small size paint brush storage lid for artists using small containers; a medium size paint brush storage lid for painters using up to five gallon liquid-containers; and a large size paint brush storage lid for industrial users using up to 55 gallon containers.

16. A paint brush storage lid supported upon a container for holding liquids, comprising:

a) a resilient, one piece paint brush storage lid made of a light transmissive material to provide a visual indication of the position of the paint brush in relation to a liquid level in the liquid container, the paint brush storage lid having a flat portion sized to cover the top portion of the liquid container;

b) the resilient, one piece paint brush storage lid also having a depending rim portion which extends below the flat portion to strengthen the outer periphery of the paint brush storage lid;

c) the resilient, one piece paint brush storage lid further having a hollow tapered neck portion which projects above the flat portion, said hollow tapered neck portion of oblong shape in a direction perpendicular to the plane of the flat portion, said hollow tapered neck portion sized to accommodate the width of a paint brush sized to be received within the container;

d) the resilient, one piece paint brush storage lid with an elongated aperture in the paint brush storage lid, the elongated aperture with elongated parallel sides and rounded ends sized to receive the handle of the paint brush therethrough, the elongated aperture located in the uppermost portion of the hollow tapered neck portion of the paint brush storage lid; said elongated aperture sized to slidably receive and frictionally releasably secure the handle portion of said paint brush therethrough;

and the paint brush handle portion is positioned through the elongated aperture beneath the hollow tapered neck portion, to position and immerse a plurality of paint brush bristles extending from the paint brush handle portion, the plurality of paint brush bristles extending substantially within the liquid in the liquid container, to store the paint brush without cleaning, while covering the liquid in the liquid container so the liquid does not substantially evaporate.

17. The paint brush storage lid of claim 16, wherein the paint brush storage lid is molded of a resilient polyurethane, having a wall thickness selected from a range of one-sixteenth of an inch to one quarter of an inch.

18. The paint brush storage lid of claim 16, wherein the liquid stored within the liquid container is selected to be at least one of: paint, varnish, paint thinner, or other liquid material subject to evaporation over time.

19. The paint brush storage lid of claim 16, wherein the flat portion of the paint brush storage lid may be placed upon the top portion of a liquid container, the liquid container of a smaller size than the paint brush storage lid, thus adapting a small size paint brush storage lid for artists using small liquid containers; a medium size paint brush storage lid for painters using up to five gallon liquid containers; and a large size paint brush storage lid for industrial users using up to 55 gallon liquid containers.

* * * * *